US007228595B2

(12) United States Patent
Tudora et al.

(10) Patent No.: US 7,228,595 B2
(45) Date of Patent: Jun. 12, 2007

(54) ANTI-RATTLE DOOR ASSEMBLY

(75) Inventors: Sorin S. Tudora, Ontario (CA); Daniel I. Udriste, White Lake, MI (US); Michael K. Hietbrink, Pickney, MI (US); Vasanth K. Suratkal, Bloomfield, MI (US); Robert J. Hunt, Davisburg, MI (US); John K. Carlisle, Fraser, MI (US)

(73) Assignee: Keykert USA, Inc., Wixom, MI (US)

( * ) Notice: Subject to any disclaimer, the term of this patent is extended or adjusted under 35 U.S.C. 154(b) by 0 days.

(21) Appl. No.: 10/689,671

(22) Filed: Oct. 22, 2003

(65) Prior Publication Data

US 2004/0148736 A1 Aug. 5, 2004

Related U.S. Application Data

(60) Provisional application No. 60/419,961, filed on Oct. 22, 2002.

(51) Int. Cl.
*E05F 5/02* (2006.01)

(52) U.S. Cl. ..... 16/86 B; 292/DIG. 39; 49/504

(58) Field of Classification Search ..... 16/86 C, 16/86 B, 86 A, DIG. 6; 49/504; 292/DIG. 39, 292/341.18, 341.19; 296/207, 146.9
See application file for complete search history.

(56) References Cited

U.S. PATENT DOCUMENTS 1,089,193 A * 3/1914 Ervien ..... 292/15
1,447,271 A * 3/1923 Soss ..... 16/85
1,980,295 A * 11/1934 Schnell ..... 292/340
2,210,989 A * 8/1940 Sutherland ..... 292/49
2,215,914 A * 9/1940 Coffey ..... 292/45
3,358,318 A * 12/1967 Ingham ..... 16/82
3,393,019 A * 7/1968 Kapanka et al. ..... 384/47
3,473,835 A 10/1969 Boyriven
3,526,442 A * 9/1970 Winlof ..... 384/406
3,888,445 A * 6/1975 Pence ..... 403/189
4,086,681 A * 5/1978 Nakanishi ..... 16/49
4,198,833 A * 4/1980 Fleischauer et al. ..... 474/62
4,544,192 A * 10/1985 Angle et al. ..... 292/341.18
4,997,221 A * 3/1991 Tolle et al. ..... 292/275
5,152,487 A * 10/1992 Defatte et al. ..... 248/225.11
5,226,302 A * 7/1993 Anderson ..... 70/159
5,937,585 A * 8/1999 Tidbury et al. ..... 49/504

FOREIGN PATENT DOCUMENTS

EP 0 495 498 7/1992

* cited by examiner

*Primary Examiner*—Brian E. Glessner
*Assistant Examiner*—Mark Williams
(74) *Attorney, Agent, or Firm*—Laurence A. Greenberg; Werner H. Stemer; Ralph E. Locher

(57) ABSTRACT

An anti-rattle door assembly includes a first member and a second member. The first member includes a first base plate and a roller disposed on the first base plate. The second member is configured to receive the roller of the first member. The second member includes a bumper that is configured to at least partly enclose the roller of the first member when the first member and the second member are engaged.

15 Claims, 7 Drawing Sheets

ANTI-RATTLE DOOR ASSEMBLY

This application claims the benefit of U.S. Provisional Application No. 60/419,961, filed Oct. 22, 2002, which is herein incorporated by reference in its entirety.

BACKGROUND

1. Field of the Invention

The present invention relates generally to an anti-rattle door assembly, and more particularly, to a vehicle door incorporating such an assembly.

2. Background of the Invention

Currently almost all vehicles that are equipped with a tailgate, e.g., sport utility, station wagon, and the like, have some kind of mechanism to stabilize the tailgate assembly in the cross car and up and down directions of the vehicle. Most commonly used systems are wedges made of plastic or rubber. Some of these systems have a built-in adjustment feature that allows a user to adjust the systems to achieve an optimal balance between closing efforts and stability. In such systems, a wedge is received in a wedge receiver which slides relative to the wedge, thus causing high frictional forces between them and contributing to high closing efforts. Any misalignment of the parts, which can occur over lifetime, e.g., door sag, can disrupt the relation of the two mating components relative to each other. This results in high operation efforts to close the door.

U.S. Pat. No. 5,937,585 discloses an anti-rattle door assembly. The assembly includes a first member on a vehicle door and a second member which is provided on a part of the vehicle defining the door. The first member includes a roller serving as a guide for directing alignment between the first member and the second member. The roller is rotatably mounted on a base plate. When the door is closed, the roller traverses along a tapered face of a recess provided within the second member so that the roller rolls up the upwardly inclined ramp, thereby lifting the vehicle door and aligning the first and second members. The roller is then received in a semi-circular recess having a diameter which is slightly larger than that of the roller. Wedge elements in cooperation with springs stabilize the position of the roller within the recess and the position of the first member with respect to the second member.

BRIEF SUMMARY OF THE INVENTION

The present invention is an anti-rattle door assembly. The present invention is an anti-rattle door assembly providing better adjustment features that allow users to adjust the assembly. A preferred embodiment of the invention provides an anti-rattle door assembly for a vehicle that includes a first member and a second member. The first member is disposed on a door of the vehicle and the second member is disposed on a part of the vehicle that defines the door. The first member includes a first base plate and a roller on the first base plate. The second member is configured to receive the roller of the first member. The second member includes a depression to receive the roller when the door is closed. The second member also includes a bumper element that at least partly encloses the roller when the door is closed (i.e., when the first member and the second member are engaged). The bumper element ensures that there is no noise when the door is closed. It assists to dampen the swing tailgate-closing event by absorbing part of the energy. It also helps to maintain a force on the roller to keep the gate from chucking during driving or when the vehicle is being accelerated or decelerated.

Preferably, the roller is provided with a section of high lubricity at the outer circumference thereof, thereby reducing high friction forces during operation of the door. Further, preferably, the section of high lubricity is a ring mounted around the outer circumference of the roller.

In order to assist adjustment of the assembly, the second member may include a second base plate and a roller receiving part that is adjustable relative to the second base plate. Preferably, the roller receiving part includes at least one groove for partial engagement of the second base plate in order to ensure that the positioning direction is defined.

Further, the roller is adjustable relative to the first base plate before fixing it thereto. Preferably, wedged means are provided at the roller and at the roller base for mutual engagement to assist in positioning of the roller relative to the roller base.

Furthermore, one of the roller and the roller base may include a dovetail halving and the other one of the roller and the roller base may include a complementary dovetail halving to define the positioning direction of the first member. The arrangement should be such that also orthogonal positioning with respect to the adjustment of the second member is possible. For example, if an adjustment of the second member in horizontal direction is attempted, the first member can be positioned in vertical direction.

Another aspect of the invention provides for a vehicle door incorporating an anti-rattle door assembly as defined above.

DETAILED DESCRIPTION OF THE INVENTION

References will now be made in detail to preferred embodiments of the present invention, and examples of which are illustrated in the accompanying drawings.

Figure 1:
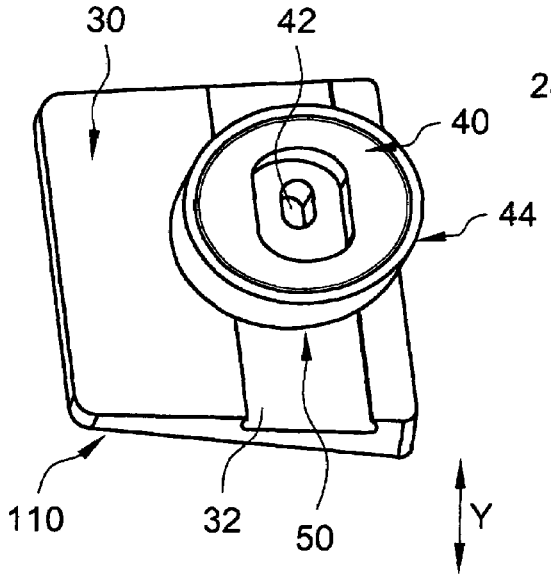
FIG. 1 is a perspective view of a first member of an anti-rattle door assembly according to a preferred embodiment of the present invention.
Figure 2A:
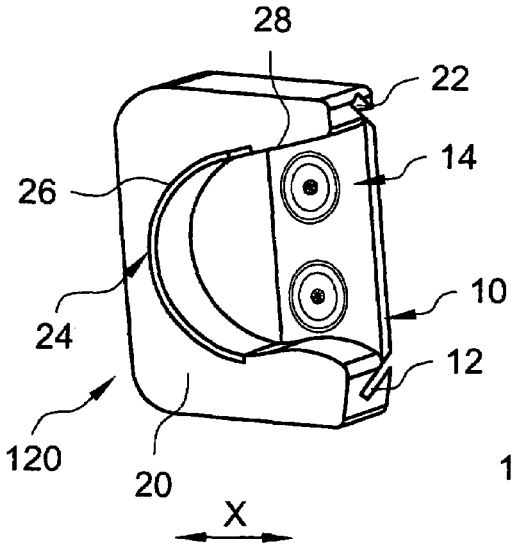
FIG. 2A is a perspective view of a second member of an anti-rattle door assembly according to the preferred embodiment of the present invention.
Figure 2B:
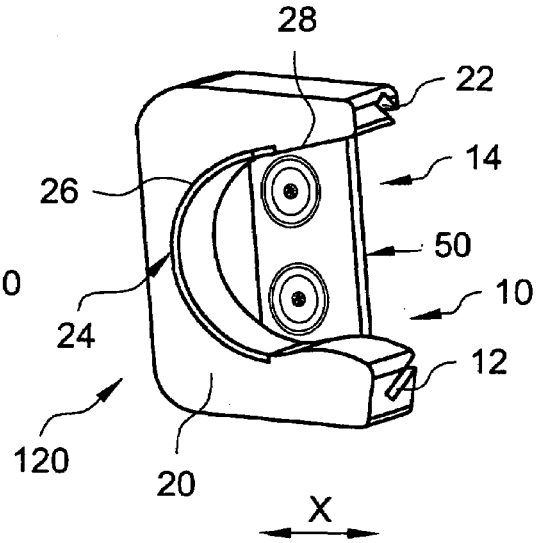
FIG. 2B is similar to FIG. 2A, showing the horizontal displacement of the base plate relative to the roller receiving part.

The anti-rattle door assembly in the present invention includes a first member to be mounted on a door of a vehicle and a second member to be mounted on a part of the vehicle defining the door (i.e., a door post of the vehicle). FIGS. 1 and 2 show the first member and the second member of the anti-rattle door assembly, respectively, according to a preferred embodiment of the present invention.

FIG. 1 is a perspective view of the first member 110 of an anti-rattle door assembly according to a preferred embodiment of the present invention. First member 110 includes a wedge-shaped base plate 30 and a roller 40 mounted on base plate 30. Base plate 30 is, when in use, attached to a door of a vehicle by suitable fastener 42, for example a screw. Roller 40 is mounted on base plate 30 so that roller 40 is adjustable in vertical direction, as indicated by the arrow Y. A ratchet is provided at the first base plate 30. Ratchets 50 are also provided at the roller 40 and at a second base plate 10 of the second member 120 for mutual engagement to assist in positioning the roller 40 relative to the second base plate 10. Preferably, roller 40 has cylindrical shape and is made of a tough plastic material, such as Nylon or polybutyleneterephthalate (PBT). A roller ring 44 is mounted around roller 40. Preferably, roller ring 44 is made of a plastic material that has high lubricity, such as acetal, in particular polyvinyl acetal. Therefore, even though roller 40 is fixed to base plate 30 and cannot rotate, roller 40 can smoothly slide into a roller receiving part 20 (shown in FIG. 2) in a second member 120 of the anti-rattle assembly of the present invention. To assist adjustment, base plate 30 includes a dovetail-shaped recess 32, into which a wedge is cut. Roller 40 carries a complementary wedge on its back side facing dovetail-shaped recess 32.

FIG. 2 is a perspective view of second member 120 of an anti-rattle door assembly according to the preferred embodiment of the present invention. Second member 120 includes a base plate 10. Base plate 10 is, when in use, attached to a part of a vehicle defining the door or a frame of the door. Base plate 10 includes a ratchet 50 at the surface facing the door post of the vehicle to help with the assembly and adjustment of the anti-rattle door assembly. Second member 120 includes inclined rails 12 at the upper and lower edges of base plate 10 and a roller receiving part 20. Inclined rails 12 are received in respective grooves 22 of roller receiving part 20. Once the adjustment is completed, base plate 10 may be fixed to the door post by suitable fasteners 14. Grooves 22 of roller receiving part 20 are slightly longer than rails 12 in order to allow horizontal displacement, as indicated by arrow X, of roller receiving part 20 with respect to base plate 10. Roller receiving part 20 and base plate 10 then may be fixed relative to one another by suitable means. Roller receiving part 20 has a guide recess 28 configured to receive roller 40. Guide recess 28 includes a substantially semi-circular abutment face with a semi-circular cut-out 26, in which a bumper element 24 is mounted. Bumper element 24 is preferably made of a dampening material, such as rubber or the like.

To adjust a system, the operator positions roller 40 relative to roller base 30 and snug fastener 42. Then the operator closes the door so that roller 40 engages receiving recess 28. Roller 40 moves along the ratchet 50 and is thereby set in the correct position. Then, the operator fixes fastener 42 fully. On the receiver side, the operator can position roller receiving part 20 with respect to base plate 10 to ensure that roller 40 comes close to the bumper element 24 when the door is closed.

The position of the ratchet is irrelevant to the assembly of the invention, principally it can be anywhere on the door, provided its functions can be performed.

Figure 3:
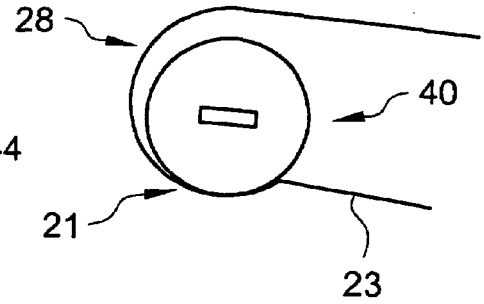
FIG. 3 shows an anti-rattle door assembly accordingly to the preferred embodiment of the present invention.

FIG. 3 shows the roller 40 within receiving recess 28. For the sake of clarity, all other components of the anti-rattle door assembly are omitted. A depression 21 is provided at the bottom part of guide recess 28 in which roller 40 rests after it has passed ramp 23 As the roller 40 slides in at the fully closed position of the door, it drops, preferably, by about 1.5 mm to further stabilize the door.

Figure 4:
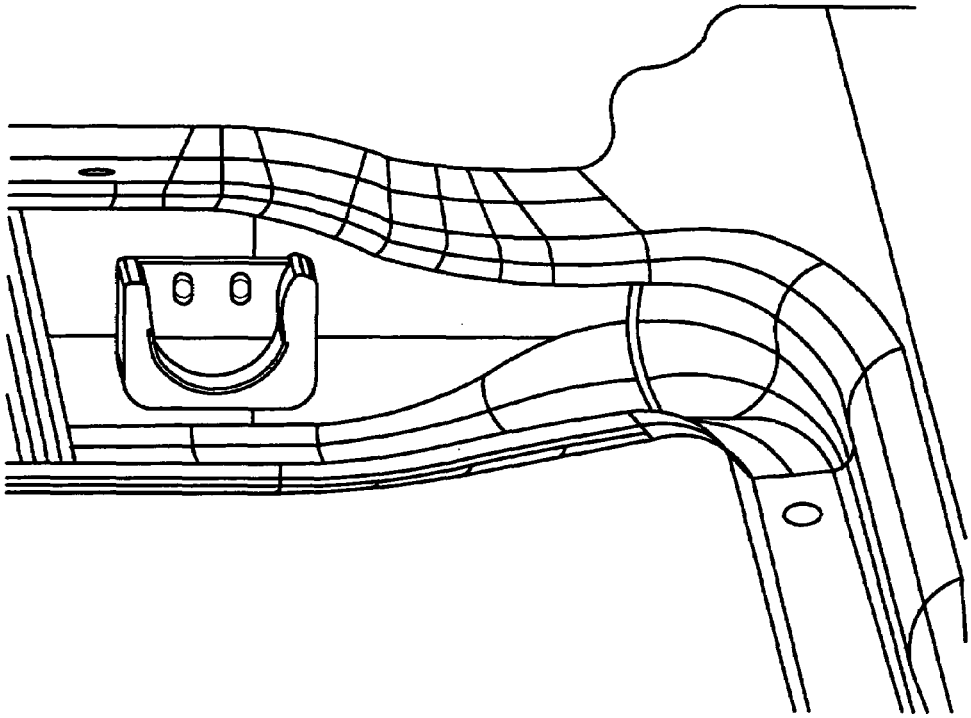
FIG. 4 shows the second member of an anti-rattle door assembly provided on a part of a vehicle defining a door according to the preferred embodiment of the present invention.
Figure 5:
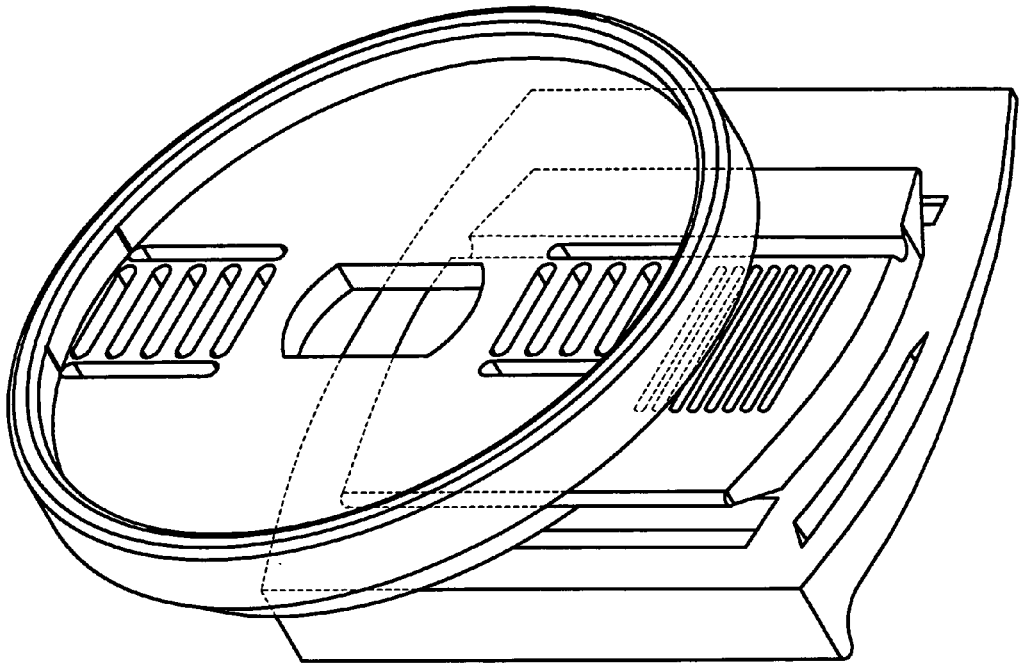
FIG. 5 is a perspective view of an anti-rattle door assembly according to another preferred embodiment of the present invention.
Figure 6:
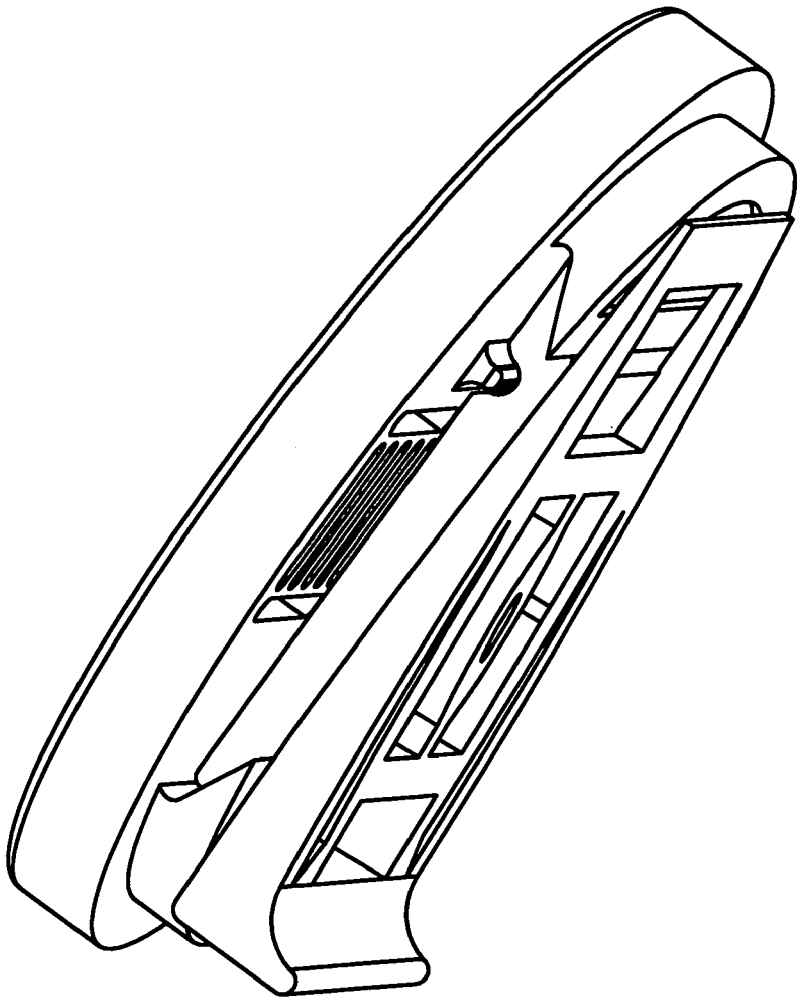
FIG. 6 is a perspective view of an anti-rattle door assembly according to another preferred embodiment of the present invention.
Figure 7:
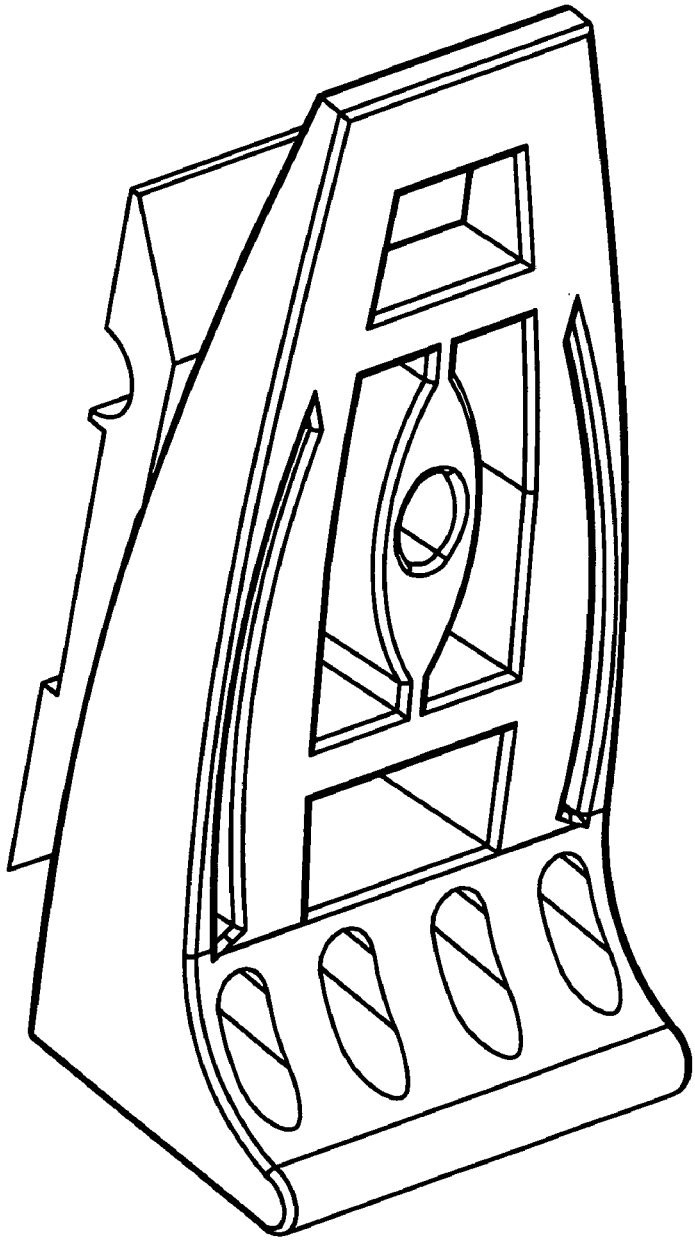
FIG. 7 is a perspective view of a first member of an anti-rattle door assembly according to another preferred embodiment of the present invention.
Figure 8:
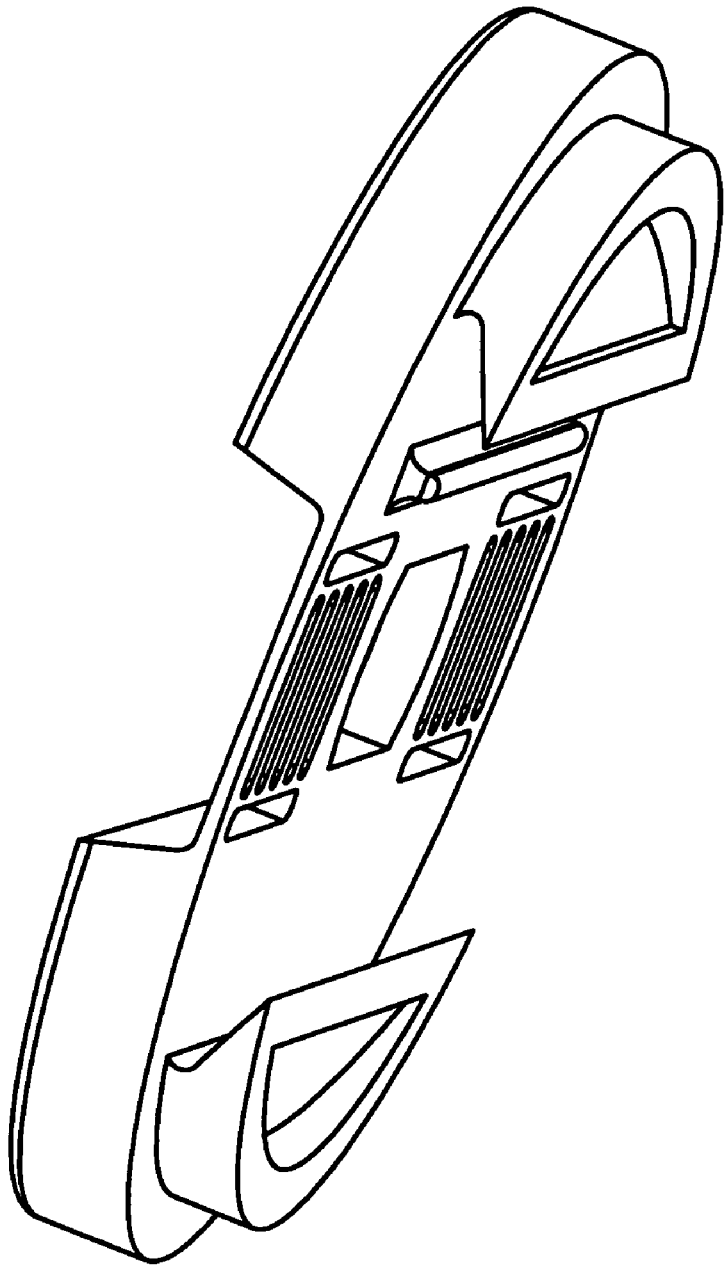
FIG. 8 is a perspective view of a second member of an anti-rattle door assembly according to another preferred embodiment of the present invention.
Figure 9:
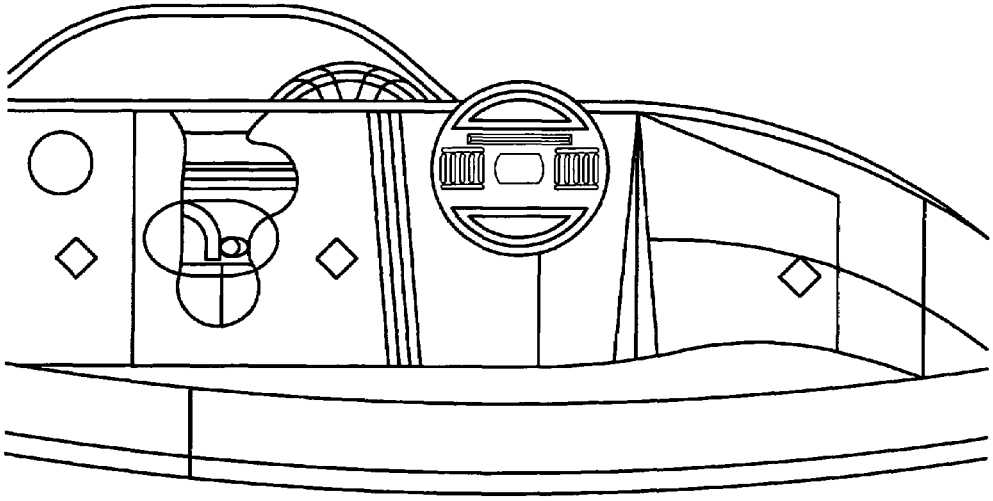
FIG. 9 shows an anti-rattle door assembly provided on a vehicle according to a preferred embodiment of the present invention.

FIG. 4 shows the second member of an anti-rattle door assembly provided on a part of a vehicle defining a door according to the preferred embodiment of the present invention.

In an alternate embodiment, the first member may be disposed on a door of the vehicle and the second member may be disposed on a part of the vehicle that defines the door.

The features disclosed in the foregoing description, in the claims and/or in the accompanying drawings may, both separately and in any combination thereof, be material for realizing the invention in diverse forms thereof.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. An anti-rattle door assembly for a vehicle, comprising:

a first member including a first base plate and a roller non-rotatably disposed on said first base plate, said roller having a section of high lubricity at an outer circumference thereof;

a second member having a second base plate and a roller receiving part for receiving said roller of said first member, said roller receiving part having a guide recess formed therein;

an adjusting system including ratchets each disposed at a respective one of said roller and said second base plate, for self-adjusting said roller into a correct position relative to said guide recess, upon closing the door and engaging said roller in said guide recess;

a fastener for fixing said roller in said correct position; and a bumper element associated with said second member, said bumper element being mounted in said guide recess and being configured to at least partly enclose said roller when said first member and said second member are engaged.

2. The anti-rattle door assembly according to claim 1, wherein said section off high lubricity includes a ring mounted around the outer circumference of said roller.

3. The anti-rattle door assembly according to claim 1, wherein said section of high lubricity is made of acetal.

4. The anti-rattle door assembly according to claim 1, wherein said second member includes a second base plate and said roller receiving part is displaceable relative to said second base plate.

5. The anti-rattle door assembly according to claim 4, wherein said roller receiving part includes at least one groove for partial engagement of said second base plate.

6. The anti-rattle door assembly according to claim 1, wherein one of said roller and said first base plate includes a dovetail halving and the other one of said roller and said first base plate includes a complementary dovetail halving.

7. The anti-rattle door assembly according to claim 1, wherein said second member has a depression formed therein in, said roller rests in said depression when a door of a vehicle is in a closed state.

8. A vehicle door having an anti-rattle assembly, the anti-rattle assembly comprising:

a first member disposed on one of the vehicle door and a part of the vehicle defining the door, said first member including a first base plate and a roller non-rotatably disposed on said first base plate, said roller having a section of high lubricity at an outer circumference thereof;

a second member disposed on the other of the vehicle door and the part of the vehicle defining the door, said second member having a second base plate and a roller receiving part for receiving said roller of said first member, said roller receiving part having a guide recess formed therein;

an adjusting system including ratchets each disposed at a respective one of said roller and said second base plate, for self-adjusting said roller into a correct position relative to said guide recess, upon closing the door and engaging said roller in said guide recess;

a fastener for fixing said roller in said correct position; and a bumper element associated with said second member, said bumper element being mounted in said guide recess and being configured to at least partly enclose said roller when the vehicle door is in a closed state.

9. The vehicle door according to claim 8, wherein said first member of the anti-rattle assembly is disposed on the vehicle door.

10. The vehicle door according to claim 8, wherein said first member of the anti-rattle assembly is disposed on the part of the vehicle defining the door.

11. The vehicle door according to claim 8, wherein said second member of the anti-rattle assembly is disposed on the vehicle door.

12. The vehicle door according to claim 8, wherein said second member of the anti-rattle assembly is disposed on the part of the vehicle defining the door.

13. The vehicle door according to claim 8, wherein said roller receiving part is attached to said second base plate.

14. The vehicle door according to claim 13, wherein a position of said roller disposed on said first base plate is displaceable with respect to said first base plate in one direction, and wherein a position of said roller receiving part is displaceable with respect to said second base plate in another direction.

15. The vehicle door according to claim 14, wherein the one direction and the other direction are perpendicular to each other.

* * * * *